US009928716B2

(12) United States Patent
Karkowski

(10) Patent No.: US 9,928,716 B2
(45) Date of Patent: Mar. 27, 2018

(54) SYSTEM OF MONITORING A PERSON IN A LIVING SPACE

(71) Applicant: Dutch Domotics B.V., Rotterdam (NL)

(72) Inventor: Ireneusz Piotr Karkowski, Delft (NL)

(73) Assignee: Dutch Domotics B.V., Rotterdam (NL)

( * ) Notice: Subject to any disclaimer, the term of this patent is extended or adjusted under 35 U.S.C. 154(b) by 0 days.

(21) Appl. No.: 15/325,645

(22) PCT Filed: Jul. 30, 2015

(86) PCT No.: PCT/EP2015/067454
§ 371 (c)(1),
(2) Date: Jan. 11, 2017

(87) PCT Pub. No.: WO2016/020248
PCT Pub. Date: Feb. 11, 2016

(65) Prior Publication Data

US 2017/0162022 A1 Jun. 8, 2017

(30) Foreign Application Priority Data

Aug. 6, 2014 (EP) ..... 14180034

(51) Int. Cl.
*G08B 23/00* (2006.01)
*G08B 21/04* (2006.01)

(52) U.S. Cl.
CPC ..... *G08B 21/0423* (2013.01); *G08B 21/0415* (2013.01)

(58) Field of Classification Search
CPC .... A61B 5/1113; A61B 5/1115; A61B 5/1118; A61B 5/002; A61B 5/0022; A61B 5/0002; A61B 2503/08; G08B 21/04; G08B 21/06; G08B 21/0423; G08B 21/0438; G08B 21/0469; G08B 21/0476; G08B 21/0415

(Continued)

(56) References Cited

U.S. PATENT DOCUMENTS 7,110,569 B2 * 9/2006 Brodsky ..... G08B 21/0476 348/169
8,525,099 B2 * 9/2013 O'Shea ..... G08B 21/0469 340/573.1

(Continued)

OTHER PUBLICATIONS

Hayes, Tamara L. et al, Estimation of Rest-Activity Patterns Using Motion Sensor, 2010 Annual International Conference of the IEEE Engineering in Medicine and Biology Society, Buenos Aires, Argentina, Aug. 31-Sep. 4, 2010, pp. 2147-2149.

*Primary Examiner* — Thomas Mullen
(74) *Attorney, Agent, or Firm* — Richard M. Goldberg

(57) ABSTRACT

A system for monitoring a lifestyle of a person in a living space includes sensors for detecting a presence of the person and/or an activity of the person, and a processor controlled system, coupled to the sensors for deriving events caused by the person and times when the events occur, for detecting event free periods of first lengths in which no events of a predetermined group occur, and for deriving, an estimate of in-bed time on the basis of the event free period of at least the first length detected in a first observation period beginning before a usual in-bed time, and for determining an estimate of the out-bed time on the basis of the events, and event free periods of at least a second length, detected in a second observation period ending after an usual out-bed time.

15 Claims, 6 Drawing Sheets

(58) Field of Classification Search
USPC ..... 340/573.1, 573.4, 545.1, 545.6; 600/595
See application file for complete search history.

(56) References Cited

U.S. PATENT DOCUMENTS

| | | | | |
|---|---|---|---|---|
| 2002/0171551 | A1* | 11/2002 | Eshelman | G08B 21/0423 340/573.1 |
| 2005/0137465 | A1 | 6/2005 | Cuddihy et al. | |
| 2005/0278409 | A1 | 12/2005 | Kutzik et al. | |
| 2006/0058704 | A1* | 3/2006 | Graichen | A61B 5/1113 600/595 |
| 2006/0267780 | A1* | 11/2006 | Adams | A61B 5/1113 340/573.1 |
| 2009/0051524 | A1* | 2/2009 | Lim | A61B 5/00 340/501 |
| 2011/0153545 | A1* | 6/2011 | Greene | A61B 5/1113 706/54 |
| 2014/0362213 | A1* | 12/2014 | Tseng | G08B 21/0476 348/143 |

* cited by examiner 72 70 71

| 24-hour period | activity indicator | time stamp |
|---|---|---|
| 1 | begin OP1 | 22:00 |
| 1 | asleep | 23:45 |
| 1 | awake | 1:30 |
| 1 | asleep | 1:38 |
| 1 | awake | 8:55 |
| 1 | asleep | 9:06 |
| 1 | awake | 9:30 |
| 1 | end OP2 | 10:45 |

Fig. 5

SYSTEM OF MONITORING A PERSON IN A LIVING SPACE

FIELD OF THE INVENTION

The present invention relates to a system for monitoring a lifestyle of a person in a living space, comprising sensors to be located in the living space for detecting a presence of the person and/or an activity of the person and means, coupled to the sensors, for deriving events caused by the person and times when the corresponding events occur.

BACKGROUND OF THE INVENTION

Such system is inter alia disclosed in US2005/0278409. In the disclosed system the sensor signals are analyzed to determine abnormal behavior of the person. Motion sensors are used to determine if a person remains in bed a specific length of time beyond the usual waking time.

Also other deviations of the usual behavior are detected and a report generator is used to generate a scheduled periodic report.

SUMMARY OF INVENTION

It is an object of the invention to provide in a cost effective manner a system which generates more detailed and reliable information about the day and night rhythm of the person.

According to the invention this object is achieved by a system for monitoring a lifestyle of a person in a living space, which system comprises sensors to be located in the living space for detecting a presence of the person and/or an activity of the person, and processing means comprising means, coupled to the sensors, for deriving events caused by the person and times when the corresponding events occur, means for detecting event-free periods of first lengths in which no events of a predetermined group occur, and means for deriving an estimate of the in-bed time on the basis of a beginning of the event-free period of at least the first length detected in a first observation period beginning before a usual in-bed time, whereby the estimate of the in-bed time is determined by said beginning and is indicative for the actual time that the person has gone to bed, and whereby the usual in-bed time is representative for a time that the person usually goes to bed.

The invention is partly based on the insight that the absence of activity close to the usual in-bed time indicates that the person has gone to bed. By starting the detection of event-free period shortly before the usual in-bed time, an occurrence is prevented in which event-free periods which are relatively long before the usual in-bed time cause errors in the determination of the estimate of the in-bed time. So in a simple and cost-effective way reliable information about the actual in-bed time is achieved.

In an embodiment of the invention the processing means comprises means for deriving an estimate of the out-bed time on the basis of the events and event-free periods of at least a second length, detected in a second observation period ending after a usual out-bed time, which estimate of the out-bed time is indicative for the actual time that the person has gotten out of bed, and which usual out-bed time is representative of a time that the person usually gets out of bed. In this embodiment also the out-bed time is reliably determined because of limiting the second observation period around the usual out-bed time.

Errors caused by detections outside the second observation period are prevented.

In a further embodiment of the invention the processing means are arranged to generate and store activities of a type asleep and corresponding time stamps in response to the detection of event-free period in the first observation periods and for generating and storing activities of the type awake and corresponding time stamp in response to detection of the events in the second observation periods, whereby the means for deriving the estimate of the in-bed time are arranged to derive the estimate of the in-bed time and estimate of the out-bed time are arranged to derive the estimate of the in-bed time from the stored activities of the type asleep and corresponding time stamps and whereby the means for deriving the estimate of the out-bed time are arranged to derive the estimate of the out-bed time from the stored activities and corresponding time stamps.

The activity indicators in combination with the corresponding time stamps enable in a simple manner the determination of the estimates of the in-bed times and out bed times.

In a further embodiment of the invention the time stamp of the type asleep corresponds to the beginning of the event-free period estimate, which is incremented with a predetermined time increment.

In this embodiment beneficial use is made of the fact that the time needed for a person to go to bed does not vary much. So with an increment of the time stamp by a value which is equal to the period that the person needs to go to bed an accurate estimate of the in-bed time can be achieved simply.

In another embodiment of the invention the system comprises at least one door sensor for detecting the opening and/or closing of an outside door of a house in which the person resides, whereby the group of events does not comprise events caused by the external door sensor, and whereby in response to an event caused by the opening and/or closing of the external door a modified algorithm is used for determining the estimate of the actual in-bed time and/or actual out-bed time.

This embodiment enables the determination of the actual in-bed and out-bed time such that it is not disturbed by the fact that the person leaves the home. In another embodiment of the invention the processing means are arranged to determine the usual in-bed time and/or the usual out-bed time on the basis of the estimates of the in-bed time and/or estimates of the out-bed time determined on preceding days.

This embodiment has the advantage that it dynamically adapts the system to changings in the usual in-bed time and out-bed time.

Further dynamic adaptation of the system is achieved by a system according to the invention, whereby the said first observation period depends on the reference in-bed time, and whereby the second observation period depends on the reference out-bed time.

In a further embodiment of the invention the said first observation period and/or said second observation period depends on a position of the day in a week. This embodiment has the advantage that it also provides very reliable results in case the person has a day and night rhythm which strongly depends on the day of the week.

BRIEF DESCRIPTION OF THE DRAWINGS

These and other aspects of the invention will be apparent from and elucidated further with reference to the embodiments described by way of example in the following description and with reference to the accompanying drawings, in which FIG. 5 shows an example of the contents of list LI 1 with activity indicators and corresponding time stamps for use in an embodiment of the system according to the invention.

DETAILED DESCRIPTION OF EMBODIMENTS

In the subsequent paragraphs, various aspects of a technique for monitoring the lifestyle of a persons, in particular the times that they go to bed and the times that the come out bed, will be explained.

Figure 1:
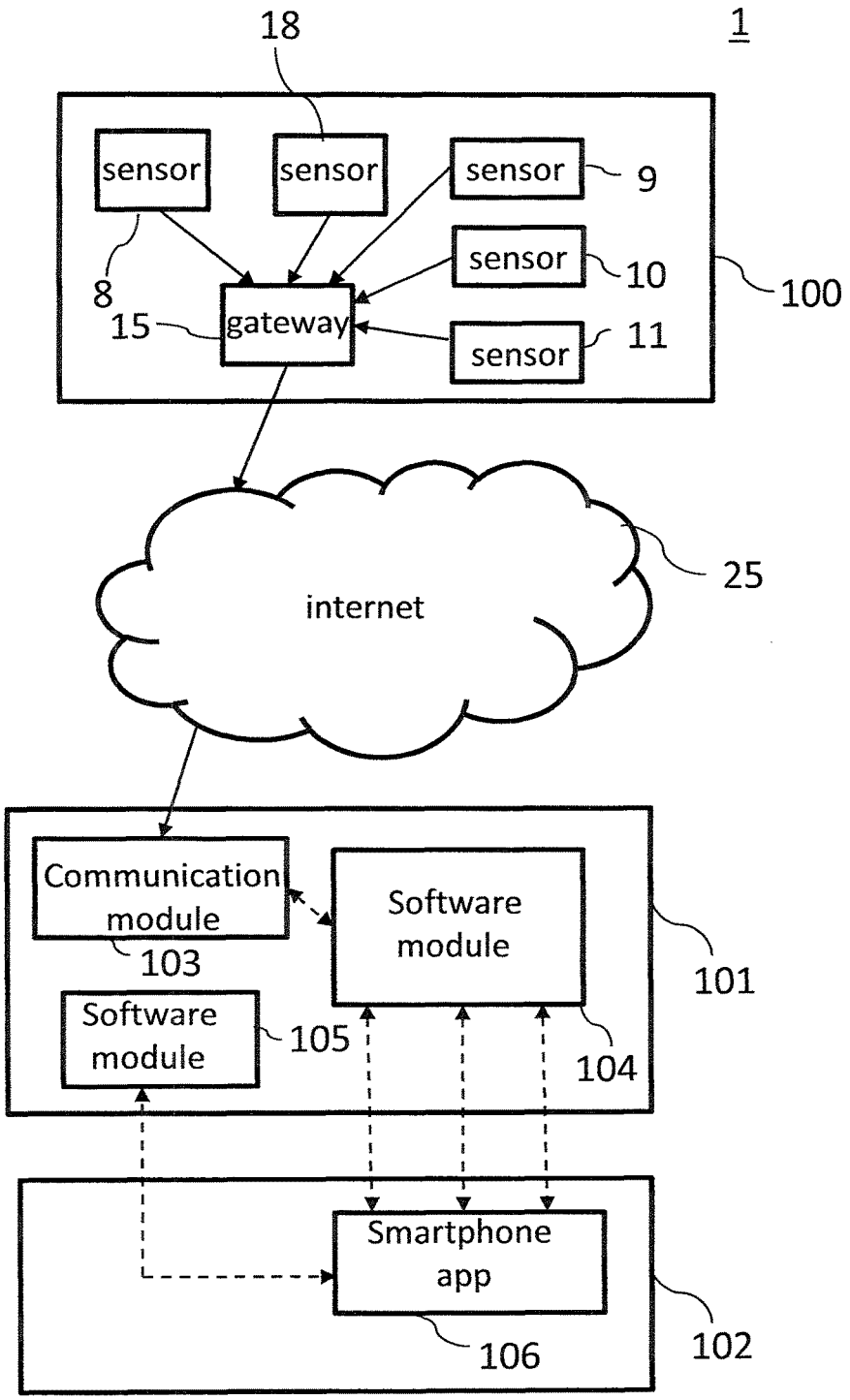
FIG. 1 shows an embodiment of a lifestyle monitoring system.

FIG. 1 shows an embodiment of a lifestyle monitoring system 1 for monitoring for example, elderly residents in their own house or in a nursery house. The system 1 comprises three major groups of components, indicated by reference signs 100, 101 and 102 respectively.

Group 100 is a group of components placed in a living space of a person to be monitored. It forms a sensor network comprising a plurality of sensors 9, 10 and 11, comprising detectors actuated by opening or closing a door or drawer, and motion sensors 8 and 18. The network is connected to Internet 25 via a gateway 15 of a usual type, e.g. a Zigbee gateway. The gateway 15 receives sensor signals generated by the sensors 8, 9, 10, 11 and 18 and outputs a data signal representing the sensor signals to the internet 25.

Group of components 101 forms a processor-controlled system, for example an internet server. Group 101 comprises a communication module 103 also connected to the internet for receiving the data signal and extracting the sensor signals from the data signal. The monitoring functionality and functionality for detection of behavior deviation and notification of detected deviation are implemented in a software module 104. The software module 104 is combined with another software module 105 for user management and scalability. All software runs on the processor-controlled system.

Group of components 102 comprises a message receiving device for example a smartphone provided with a so-called smartphone app 106. The smartphone app 106 is coupled with group 101 via a mobile phone/data network. The smartphone app 106 can be used by a caregiver or family member to install and configure the system, to inspect trends in the behavior of the elderly persons and to receive notifications/alerts about detected (mild or severe) deviations in their usual behavior.

In operation the software module 104 analyses the signals of the sensors 8, 9, 10, 11 and 18 and automatically detects deviations from the usual behavior or other deviations, which could be indicative of an emergency. The family of the elderly person or caregiver is notified/alerted via the smartphone app 106 if a deviation occurs which exceeds a predetermined threshold. This gives the caregiver or family member an opportunity to verify the situation (i.e. by phone). After that, depending on the nature of the deviation (mild or severe), they can take care that a suitable medical intervention is implemented or can involve appropriate emergency services.

Figure 2:
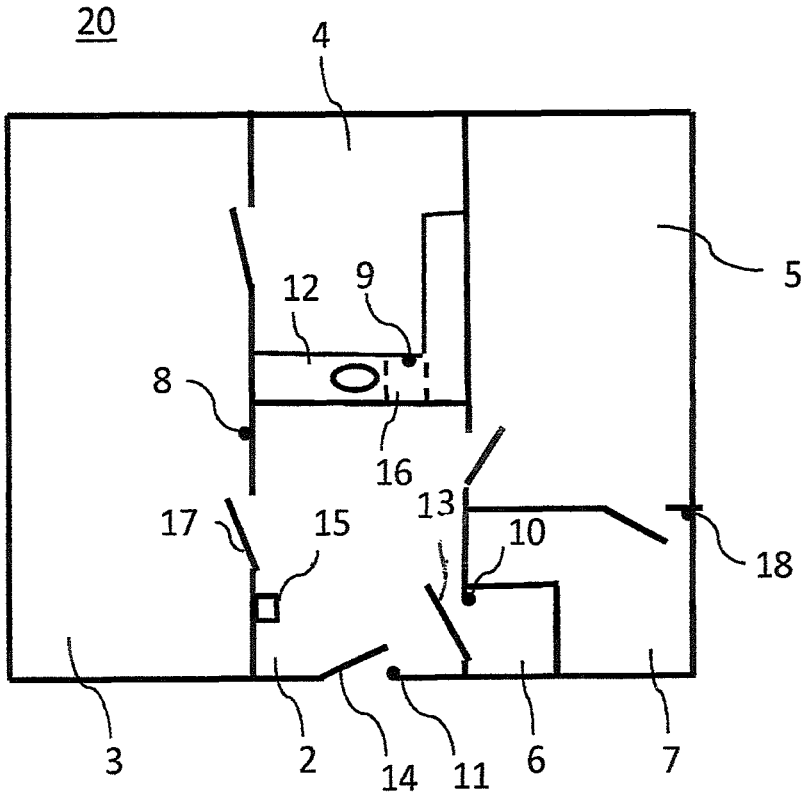
FIG. 2 shows a map of a living space 20.

FIG. 2 shows a map of a living space 20, in the form of a typical apartment for elderly persons. The apartment comprises a hall 2, a living room 3, a kitchen 4, a bedroom 5, a bathroom 7 and a toilet 6.

The sensors 8, 9, 10 11 and 18 are installed for detecting the presence and/or activity of a person in the living space 20. The motion sensor 8 is located in the living room 3 for detecting the presence of a person in the living room 3. The motion detector 18 is located in the bathroom 7 for detecting the presence of a person in the bathroom 7. The sensor 9 is a detector fixed to a drawer 16 for the utensils in a kitchen counter 12 in the kitchen 4 for detecting the opening and closing of the drawer 16. The sensor 10 is a door detector for detecting the opening and closing of a door 13 of the toilet 6. Sensor 11 is a door detector for detecting the opening and closing of an outside door 14. The gateway 15 is located in the hall 2. The sensors 8, 9, 10, 11 and 18 are coupled to the gateway 15 to submit sensor signals to the gateway 15. This coupling is preferably a wireless connection, but alternatively a wired connection can be used. The program module 104 comprises a sub program of a usual type to derive events E1, . . . , E10 from the sensor signals. These events indicate activities caused by the person in the living space 20. Event E1, indicating that a person is leaving the living room 3 and event E2, indicating that a person is entering the living room 3, are derived from the sensor signal provided by motion sensor 8 in the living room 3. Event E3, indicating the opening of the drawer 16, and event E4 indicating that the drawer 16 is closed are derived from the signal provided by sensor 9. Event E5 indicating that a person opens the door 13 of the toilet 6 and event E6 indicating that the person closes the toilet door 13 are derived from the sensor signals provided by sensor 10. Event E7, indicating that a person is leaving the bathroom 7, and event E8, indicating that a person is entering the bathroom 7, are derived from the sensor signal provided by motion sensor 18 in the bathroom 7. Event E9 indicates that outside door 14 is opened and event E10 indicates that the outside door 14 is closed. Events E9 and E10 are derived from the detector 11.

In the embodiment described above two motion sensors and three door/drawer detector are used as basis for the detection of the events. It will be clear that the number of detectors can vary. More or less detectors can be used in the sensor network. For a cost effective system a limited number of sensors is preferable. The best balance between the number and type of sensors depends on the structure of the living space 20. In case the toilet and bathroom are combined in one room one sensor instead of two sensors as in the described embodiment suffices.

Also other type of sensors than door/drawer and motion sensors may be used, for example a sensor which detects that an apparatus or lamp is switched on and/or off or a sensor which detects whether a telephone call is made.

Figure 3:
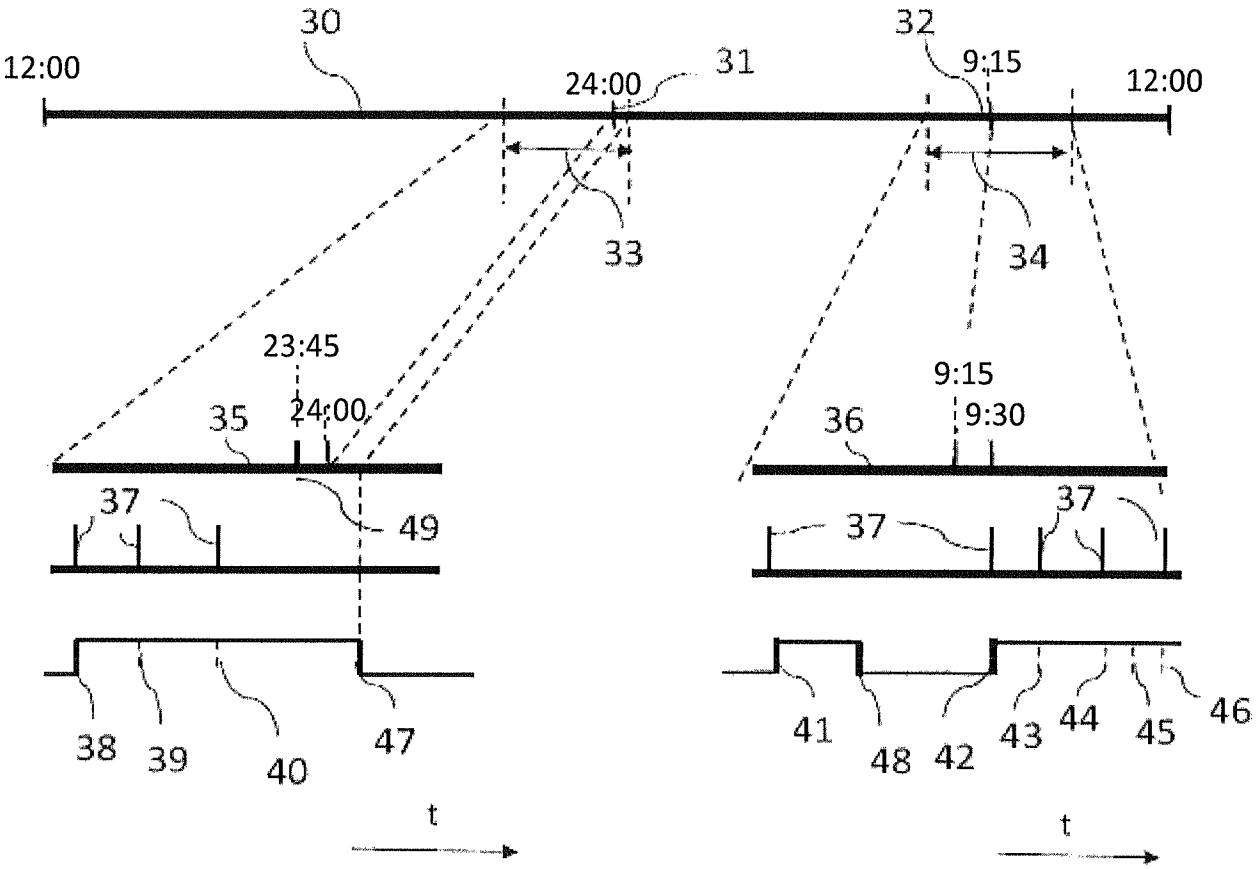
FIG. 3 shows several periods of an exemplary day and night rhythm of a person.

FIG. 3 shows several periods of an exemplary day and night rhythm of a person. Line 30 represents a 24 hour period starting for 12:00 to 12:00 the next day. With reference sign 31 the usual time that the person goes to bed is indicated. In this example the usual time is 24:00. Hereinafter this time will be referenced to as usual in-bed time. With reference sign 32 the usual time that the person gets out of bed is indicated. In this example this is 9:15. Hereinafter this time is referenced as usual out-bed time. A first observation period (OP1) which starts before the usual in-bed time is indicated by reference sign 33 and a second observation period (OP2) located around the usual out-bed time is indicated by reference sign 34.

In FIG. 3 the first observation period (OP1) and the second observation period (OP2) are also shown in enlarged form, indicated by reference sign 35 and 36 respectively.

Points in time at which one of the events E1, . . . , E8 occurs are indicated by reference sign 37.

In the first observation period (OP1) it is checked whether event-free periods of at least a predetermined length L1, for example 60 minutes, occur.

In the second observation period (OP2) it is checked whether event-free periods of at least a predetermined length L2, for example 30 minutes occur. In principle the length of L1 and L2 can be equal, but may be different. Preferably the length L2 is shorter than L1 as will be explained later on in the description.

The checking of the occurrences of the event-free periods can be done in several manners. In a very suitable manner a timer is used which resets each time that one of the events E1, . . . , E8 is detected and expires is after a period corresponding with the length (L1 or L2) of the event-free period. In FIG. 3 points in time at which the timer is reset are indicated by reference signs 38, . . . , 46. A point in time at which the timer expires are indicated by reference sign 47 for the timer used in the first observation period (OP1). For the timer used in the second observation period (OP2) a point in time at which the timer expires is indicated by reference sign 48.

The actual time at which the person goes to bed, hereinafter referred to as actual in-bed time, can be estimated as follows. The first observation period (OP1) begins at a point of time located a predetermined period before the usual in-bed time, for example 135 minutes before the usual in-bed time. Starting from the begin of the first observation period (OP1) each time that one of the events E1, . . . , E8 is detected the timer is reset. Each detection of such event is an indication that the person has not yet gone to bed. At the point in time 47, at which an event-free period of with a length of at least L1 is detected, it can be assumed that the person has gone to bed a while ago. Assuming that the time required to go to bed is substantially always the same, then an estimate of the actual in-bed time can be made on the basis of the point in time of the latest reset of the timer and the time period that a person in average needs to go to bed. A usual value of the time period required to go to bed is in the order of 15 minutes. In FIG. 3 this point in time of the latest reset of the timer is indicated by reference sign 40. In case the average time required to bed is assumed to be equal to 15 minutes the estimate of the actual in bed time is the point of time indicated by point 40 incremented with 15 minutes. In the example of FIG. 3 this estimate of the actual in-bed time is 23:45, indicated by reference sign 49. After the detection of the period with a length of at least L1 the first observation period (OP1) can be ended. In FIG. 3 this is at point in time 47.

The actual time at which the person comes out bed, hereinafter referred to as the actual out-bed time can be estimated as follows. Usually at the start of the observation period (OP2) the person is in bed. In the second observation period (OP2) each time that one of the events E1, . . . , E8 is detected the timer for this observation period is reset. Each detection of such event is an indication that the person has come out bed. However in case this event is followed by an event-free period with the length L2 it is assumed that the person returned in bed. In FIG. 3 this is the case in the situation indicated in the period between points in time 41 and 48. At the point in time 41 the timer is reset. At point of time 48 the timer expires, which means that an event-free period with a length of at least L2 occurred, indicating that the person has returned in bed.

At the point in time 42 the timer is reset again as a result of the detection of an event 37. This event is the first one of a sequence of events which are located at short time distances, shorter than the length L2, from each other. At the end of the of the second observation period (OP2) the timer has not yet expired. Then it can be considered as that point in time 42 as an estimate of the actual out-bed time. In FIG. 3 the value of the estimate is 9:30.

In FIG. 3 the first and second observation periods OP1 and OP2 are separated from each other. It is preferable to also determine in the period between the end of the first observation period and the begin of the second observation period event-free periods of predetermined length L3, which can for example be equal to L2, but other length are also possible. Preferably L3 is shorter than L1. The events detected in the period between observation period OP1 and OP2 usually are events caused by activities wherefore the person only shortly leaves the bed, for example for visiting the toilet 6 or bathroom 7.

By detecting event-free periods between observation period OP1 and observation period OP2 it can be reliably determined whether at the beginning of the observation period OP2 the person is still in bed or already out of bed. If in the latter situation the person does not return to the bed in the second observation period OP2 the estimate of the out-bed time is the point of time that the first event is determined of a sequence of events with distances between the subsequent events shorter than L2.

In this situation it has sense to send a notification to the caregiver or family member via the mobile phone app 106 that the person has come out bed early at a point in time which is far before the usual out-bed time.

It may incidentally occur that at the end of the of the second observation period the person is still in bed, for example because he/she is ill. Than an estimate of the out-bed time can be made on the basis of event detection after the end of the second observation period OP2. If such situation occurs it is preferable to send a warning notification via the mobile phone app 106 to the caregiver or family member. In case after a substantial period after the end of the observation time OP2 still no estimate for the out-bed time is available a second notification indicating that that there is a severe deviation of the out-of bed time, which needs an action from the caregiver or family member.

Figure 4:
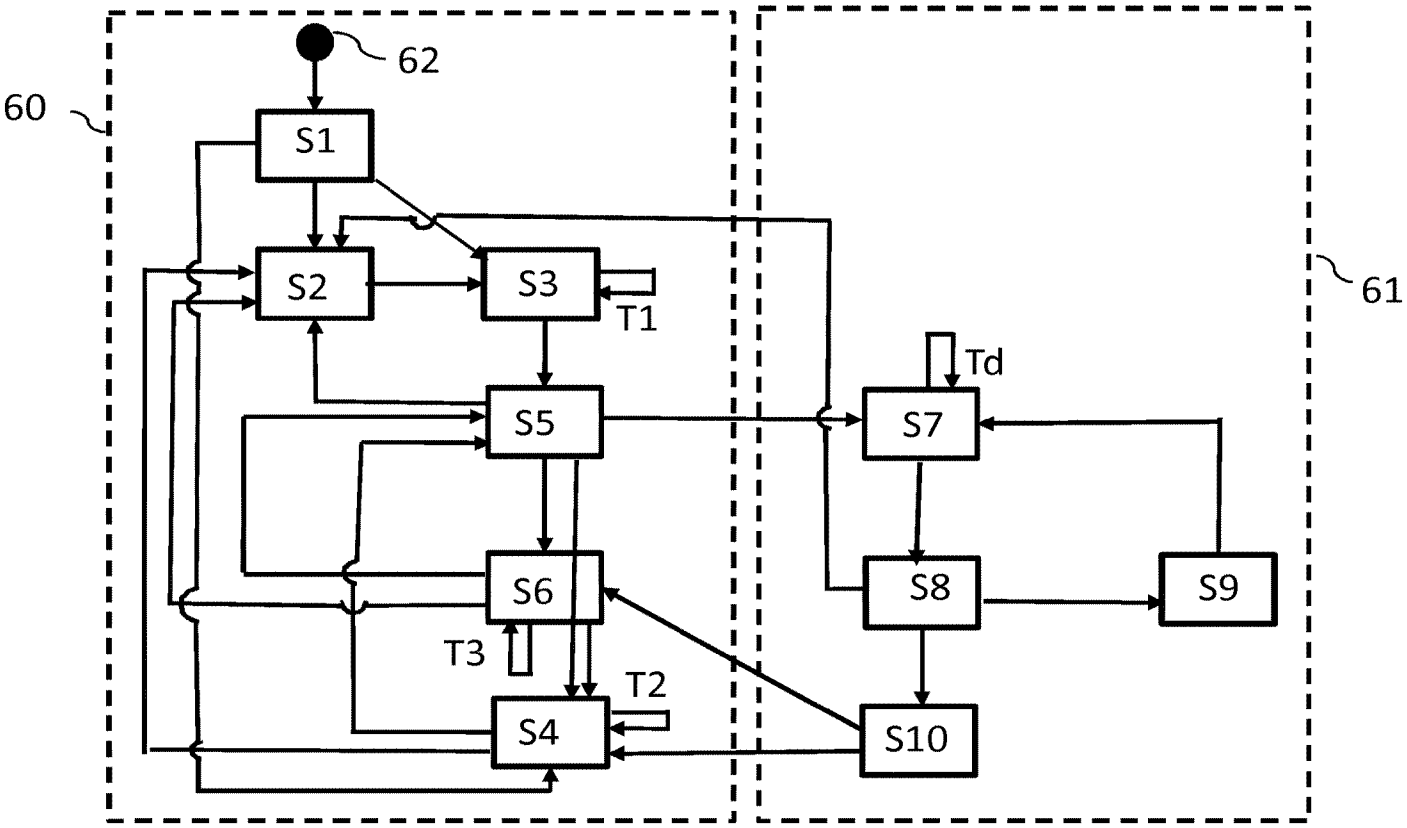
FIG. 4 shows a state diagram of the possible operation states of a part of an embodiment of a software module for a system according to the invention for determining the estimates of the in-bed time and out-bed time according to the invention.

FIG. 4 shows a state diagram of the possible operation states of a part of an embodiment of a software module for determining the estimates of the in-bed time and out-bed time according to the invention. Switches to new states are dependent on the period of a day. The following three periods can be distinguished:

- Period P1. This is a period, which begins at the end of the observation period OP2 and ends at the beginning of the observation period OP1. This period ends when the predetermined period before the usual in-bed time starts. In the example described with reference to FIG. 3 the predetermined period is 135 minutes. During period P1 the person is usually awake.
- Period P2. This is the period, which begins at the beginning of the observation period OP1 and ends at the beginning of observation period OP2. The person usually goes to bed in the first part of period 2.
- Period P3. This the observation period OP2. In period P3 the person usually comes out bed.

The state diagram is split into two parts; a first part 60 with the states which are adopted in response to events E1, . . . , E8.

The events caused by the opening or closing of the outside door 14 have to be processed in a way different from the events E1 E8. It may occur that the person is leaving the home through the outside door 14. This may result in event-free periods, which do not indicate that the person has gone to bed. In response to an event caused by the opening and/or closing the outside door 14 special states will be adopted. These special states are shown in part 61 of the state diagram of FIG. 4. Details of this part will be discussed later on in the description. Firstly the program of the software module 104 will be explained with reference to part 60 for the situation that only events E1 E8 are detected.

Reference sign 62 indicates the start of the program performed by the program module. After the start of the program a state S1 is adopted. In this state the actual situation is still undefined. When the program is in state S1 it is determined whether the actual time is within periods P1, P2 or P3. Depending on the outcome of the detection the program switches to states S2, S3 or S4. In case the actual time is within period P1 the program switches to state S2, In case the actual time is in period P2 the program switches to state S3 and in case the actual time is in period P3 the program switches to state S4.

Assuming now that the actual time was in period P1 then in state S2 the program waits until the actual time reaches the beginning of period P2. As soon as the actual time reaches the begin of period P2 a timer T1 is reset to its start value. Further a timer set time ST, equal to the actual time that a timer is set is stored. The timer T1 is of a type that expires after the period L1 after it has been (re)set to its start value. Moreover the state is switched to S3. As long as the program is in state S3 the timer T1 is reset to its start value each time that one of the events E1, . . . , E8 is detected. With each reset the timer set time ST is updated. If no new event is detected within a period with length L1 the timer T1 expires, which means that an event-free period with a length L1 occurred. Then an activity indicator of the type asleep and a time stamp equal to stored timer set time ST plus 15 minutes is stored in an activity list LI1 within a data memory of the server 101 and the program switches to the state S5. The status indicator of the type asleep indicates that the person has gone to bed. The time stamp is an estimate of the time that the person has gone to bed.

In the state S5 the program waits until an event is detected.

In case one of the events E1, . . . , E8 is detected the program switches to a new state depending on the actual time. In case the actual time is within period P1 an activity indicator of the type awake and corresponding time stamp, equal to the actual time, is stored in list LI1 and the program switches to state S2. In case the actual time is within the period P3 an activity indicator of the type awake and a time stamp equal to the actual time is stored in the list LI 1 and the program switches to a state S4. Moreover a timer T2 is reset to its start value and the timer set time ST is updated to a value equal to the actual time. The timer T2 is of a type that expires after the period L2 after it has been (re)set to its start value. In case the actual time is within the period P2 an activity of indicator of the type awake and a time stamp equal to the actual time is stored in the list LI 1 and the program switches to state S6. Moreover a timer T3 is reset to its start value and the timer set time ST is updated to a value equal to the actual time. The timer T3 is of a type that expires after the period L3 after it has been (re)set to its start value. The state S6 is representative for a so called night awake, which means that the person is out of bed in at night during a period in which the person is usually in bed.

In case in state S6 it is detected that the actual time is within period P1 the program is switched to state S2 and the timer T3 is stopped. In case it is detected that the actual time is within period P2 a timer T2 is set to its start value and the timer set time ST is updated. Moreover the program switches to state S4.

In case in state S1 the actual time is in period P3 the program switches to state S4, the timer T2 is reset to its start value and the timer set time ST is updated. In case in state S1 the actual time is in period P2 the program switches to state S3, the timer T1 is reset to its start value and the timer set time ST is updated.

In the state S4 the timer T2 is reset to its start value and timer set time ST is updated each time that one of the events E1, . . . , E8 is detected. In the state S4 it is continuously tested whether the actual time reaches period P1 or that timer T2 expires.

As soon as the actual time reaches period P1 the program is switched to state S2 and timer T2 is stopped.

If in state S4 no new event is detected within a period with length L2 the timer T2 expires, which means that an event-free period with a length L2 occurred. This situation indicates that the person returned to the bed within the period P2. An activity indicator of the type asleep and a time stamp equal to the timer set time ST plus 5 minutes, are stored in list L11. Moreover the program switches to state S5.

Part 61 of the state diagram is entered in case in state S5 an event E10 is detected which is caused by the closing of the outside door 14. Then the program is switched to state S7. Moreover an activity of the type awake and a time stamp equal to the actual time is stored in list LI1, a timer Td is reset to its start value and the timer set time is updated. Timer Td is of a type that expires after the period L4, for example 20 seconds, after it has been (re)set to its start value. As soon as timer Td expires the program switches to state S8. This state indicates that the person may have gone outside. In case in state S8 an event E9 or an event E10 is detected the program switches to state S9. If in state S9 the event E10 is detected the program switches to state S7 again. State S9 indicates that the person was outside.

In case in state S8 one of the events E1, . . . E8 is detected the program switches to state S10. Moreover an activity indicator of the type asleep and a time stamp equal to the timer set time plus 15 minutes is stored in list LI1. In case period P1 is reached in S8 the program switches to state S2, the timer T1 is reset to its start value and the timer set time is updated.

If in state S10 it is detected that the actual time is in period P2 and one of the events E1, . . . , E8 the program switches to state S6. Moreover the timer T3 is reset to its start value and the timer set time is updated. Further an activity indicator of the type awake and a time stamp equal to the actual time is stored in the list LI1.

If in state S10 it is detected that the actual time is in P3 then the program switches to state S4. Moreover the timer T2 is set to its start value and the timer set time ST is updated. Further an activity indicator of the type awake and a time stamp equal to the actual time is stored in the list L11.

As described hereinbefore by the executing of the program in program module 104 a list LI1 is created with activity indicators and corresponding time stamps. FIG. 5 shows an example of the contents of list LI1 with activity indicators and corresponding time stamps.

The list LI1 comprises a column 70 in which the activity indicator is stored and a column 71 in which the corresponding time stamp is stored. Further the list may comprise a column in which the 24-hours period is stored to which for the stored activity indicator and time stamps. In the list LI1 of FIG. 5 also the beginning of observation period OP1 and the end of observation period OP2 are stored. The software module comprise a program for determining the estimate of the actual in-bed time and the actual out-bed time on the basis of the contents of list LI1. This program determines the first activity indicator of the type asleep in the list and assigns the value of the corresponding time step to the estimate of the in-bed time for the 24 hour period. For this particular example the estimate of the actual in-bed time is 23:45.

The actual out bed time is indicated by the first activity indicator of the type awake after the latest activity indicator of the type asleep in the list LI1 for the related 24 hours period. In the example of FIG. 5 the estimate of the out-bed time is 9:30.

As described hereinbefore the begin of the observation period OP1 and the begin and end of the second observation period OP2 are located at predetermined distances from the usual in-bed time and usual out-bed time respectively. The program module comprise software to determine the usual in-bed time and the usual out bed time on the basis of the estimates of the actual in-bed time and actual out-bed time determined in a preceding period, for example the preceding 30 days. A suitable value for the usual in-bed time and the usual out bed time are averages of the corresponding estimates in the preceding periods. However also other values are suitable, for example the mean value for the preceding period.

A suitable value for the distance between the begin of the first observation period OP1 and the usual in-bed time is in the range of 1 to 3 hours, but other values are also possible. It is important that the begin of the first observation period OP1 is early enough to determine the actual in-bed time in reliable manner in all or almost all relevant 24 hours periods.

Suitable positions for the begin and end of the second observation period OP2 and the usual out-bed time are points of times which are in the order of the standard deviation of the usual out-bed time before end after the usual out-bed time. However also other distances are suitable as long as the actual out-bed time can be reliably estimated.

It is well known that the activities of a person strongly depend on the day of the week, because often these activities show a weekly repeating pattern. For example persons may have a different activity schedule for the weekend days. This may result in different values for the in-bed times and out-bed times for different days of the week. In such situation it is beneficial to use values for the usual in-bed time and usual out-bed time, which are dependent on the day of the week. In other words the usual in-bed time depends on whether the day is a Monday, Tuesday, Wednesday, Thursday, Friday, Saturday or Sunday. Each day may have its own value for the usual in-bed time and or usual out-bed time. The program module 104 also comprises a program which checks whether there is a deviation between the actual in-bed time and the usual in-bed time and a deviation between the actual out-bed time and the usual out-bed time is such that a notification to the caregiver or family member is desired. Depending on the extent of the deviation no notification, a notification indicating a mild deviation or a notification indicating a severe deviation is sent to the care giver or family member using the mobile phone app 106.

The program module 104 preferably comprises a program for calculating a sleep quality parameter on the basis of the activities and corresponding time stamps stored in the LI1. Interesting sleep quality parameters are the number of sleep interruptions per night and the total sleep duration per night. Both are very interesting parameters, because they are indicative of the sleep quality. Each of the parameters is compared with a reference value, which indicates an usual value of the parameter. In case on the basis of the comparison an increase of the number of sleep interruptions is detected which exceeds a first threshold value a notification is send to the caregiver. Also in case on the basis of the comparison it is detected that an increase of the total sleep duration exceeds a second threshold value a notification is sent to the caregiver.

The reference values used in the comparison can be determined on the basis of the data determined over a preceding period, for example the preceding thirty days. As reference an average can be taken. However also other values can be used for example a mean value of the number of interruptions and total sleep durations determined over the preceding period.

The program can be extended with an algorithm for generating on the basis of the contents of the list LI1 graphs with historical sleep duration and sleep interruptions. In case a notification is send to the caregiver these graphs can be forwarded to the smartphone app 106 and shown to the caregiver on the screen of the mobile phone.

In the embodiments described above the software module is incorporated in an internet server. However it will be clear for the skilled man that this software can also be incorporated in a central unit located in the living space 20.

Figure 6:
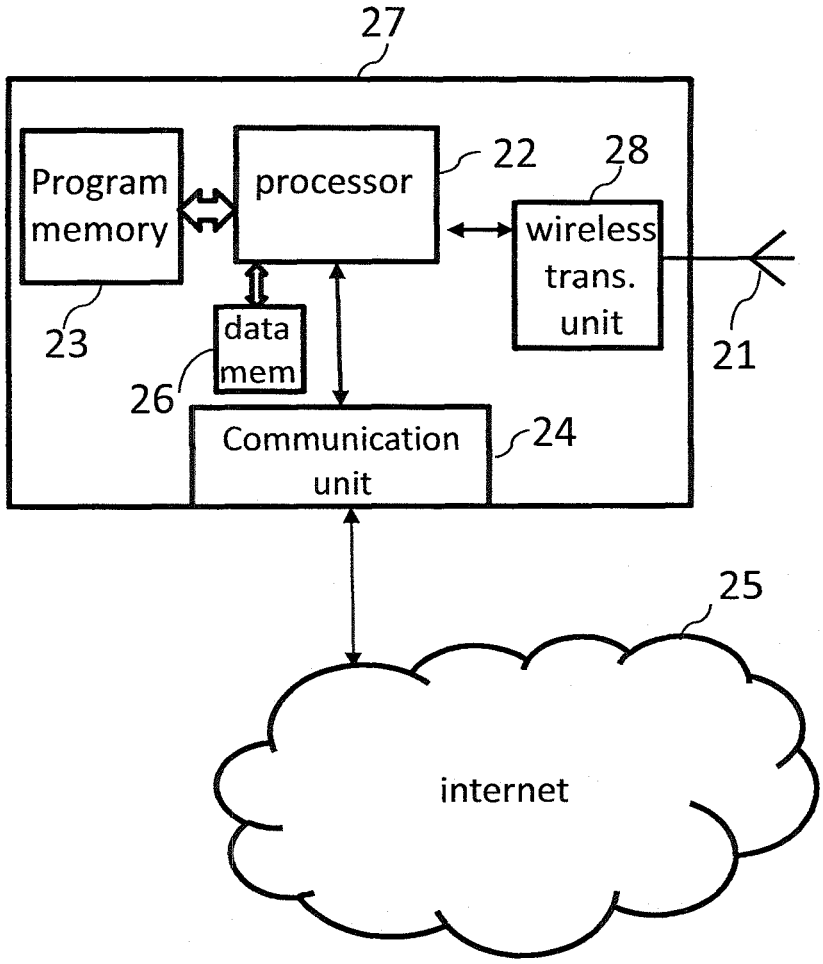
FIG. 6 shows an embodiment of a central unit for use in an embodiment according to the invention.

FIG. 6 shows an embodiment of such central unit 27. The central unit 27 comprises a program controlled processor 22. Processor 22 is of usual type, which can execute program instructions of a computer program loaded in a program memory 23. The processor 22 is coupled with a wireless transmission unit 28 for the wireless communication with the sensors 8, 9 10, 11 and 18 via an antenna 21. The processor 22 is further coupled with an Internet communication unit 24 enabling communication to the outside world via the internet 25. The central unit 27 is further provide with a data memory 26 for storing information derived during the execution of the computer program in the program memory 23. Software similar to the software of the program module 104 is loaded in the program memory 23. The program memory can be of a so-called read only type. If so a data memory 26 can be coupled to the processor 22 for storing data generated during the execution of the software.

It will also be clear for the skilled man that instead of a software controlled processor dedicated hardware can be used for implementing the invention. While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A system for monitoring a lifestyle of a person in a living space, comprising:

sensors located in the living space for detecting at least one of a presence of the person and an activity of the person, and a processor coupled to the sensors for:

deriving events caused by the person and times when the events occur, detecting event-free periods, each of a first length, in which no events of a predetermined group occur, and deriving an estimate of in-bed time on the basis of a beginning of one said event-free period of at least the first length, detected in a first observation period beginning before a usual in-bed time, whereby the estimate of the in-bed time is determined by said beginning and is indicative of an actual time that the person has gone to bed, and whereby the usual in-bed time is representative of a time that the person usually goes to bed.

2. The system as claimed in claim 1, wherein the processor derives an estimate of out-bed time on the basis of the events, and event-free periods of at least a second length, detected in a second observation period ending after an usual out-bed time, which estimate of the out-bed time is indicative of the actual time that the person has gotten out of bed, and the usual out-bed time is representative of a time that the person usually gets out of bed.

3. The system as claimed in claim 2, wherein the processor generates and stores activities of an asleep type and corresponding time stamps in response to the detection of an event-free period in the first observation period, and generates and stores activities of an awake type and corresponding time stamps in response to detection of the events in the second observation period, and wherein the processor derives the estimate of the out-bed time from the stored activities of the asleep type and corresponding time stamps.

4. The system as claimed in claim 3, wherein the system is arranged to derive a sleep quality parameter based on the activities and corresponding time stamps, which quality parameter indicates at least one of:

a number of sleep interruptions per night, and a total sleep duration per night, and wherein the system is arranged to send a notification to a caregiver in response to at least one of:

detecting that an increase in the number of sleep interruptions exceeds a first threshold value, and detecting that a decrease in the total sleep duration exceeds a second threshold value.

5. The system as claimed in claim 3, wherein one said time stamp of the asleep type corresponds to a beginning of an event-free period estimate incremented with a predetermined time increment.

6. The system according to claim 3 wherein the system is arranged to derive the out-bed time on the basis of one said time stamp corresponding to one said activity of the awake type generated after the latest generation of one said activity of the asleep type one of:

before, and within, the second observation period.

7. The system according to claim 2, wherein the system comprises at least one door sensor for detecting at least one of the opening and closing of an outside door of the living space, indicating that a person is leaving or entering the living space, and wherein, in response to an event caused by the at least one of the opening and closing of the outside door, a modified algorithm is used for determining the estimate of at least one of the actual in-bed time and actual out-bed time.

8. The system according to claim 2, wherein the system is arranged to send a notification of a first type to a caregiver when, at a first predetermined waiting time after the end of the second observation period, an estimate of the actual out-bed time is not yet available.

9. The system according to claim 8 wherein the system is arranged to send a notification of a second type to a caregiver when, at a second predetermined waiting time after the end of the second observation period, an estimate of the actual out-bed time is not yet available, which second predetermined waiting time is longer than the first predetermined waiting time.

10. The system according to claim 2, wherein the estimate of the in-bed time and estimate of the out-bed time are determined on preceding days, and wherein the processor is arranged to determine at least one of the usual in-bed time and the usual out-bed time on the basis of at least one of the estimate of the in-bed time and estimate of the out-bed time determined on the preceding days.

11. The system as claimed in claim 2, wherein the first observation period depends on a reference in-bed time, and whereby the second observation period depends on a reference out-bed time.

12. The system as claimed in claim 2, wherein at least one of the said first observation period and said second observation period depends on a position of a day in a week.

13. The system as claimed in claim 2 wherein in a third observation period, beginning at the end of the first observation period, and ending at the beginning of the second observation period, event-free periods of at least a third length are detected in order to determine whether the person has gotten out of bed before the beginning of the second observation period.

14. A processor-controlled system according to claim 1, wherein the processor includes a programmable processor and the system further comprises a memory loaded with a computer program with programming instructions enabling the programmable processor to establish functions of the processor.

15. A non-transitory computer-readable medium, comprising:

programming instructions stored on the medium, for use in the system according to claim 14.

* * * * *